US008186025B2

(12) United States Patent
Fildan et al.

(10) Patent No.: US 8,186,025 B2
(45) Date of Patent: May 29, 2012

(54) BRASSIERE BACK CLOSURE

(75) Inventors: Gerhard Fildan, Vienna (AT); Karl Wanzenböck, Teesdorf (AT)

(73) Assignee: Fildan Accessories (HK) Ltd., Kwun Tong Kowloon (HK)

( * ) Notice: Subject to any disclaimer, the term of this patent is extended or adjusted under 35 U.S.C. 154(b) by 761 days.

(21) Appl. No.: 12/256,503

(22) Filed: Oct. 23, 2008

(65) Prior Publication Data

US 2010/0101058 A1 Apr. 29, 2010

(51) Int. Cl.
*A44B 13/00* (2006.01)
*A41F 1/00* (2006.01)
*A41C 3/00* (2006.01)

(52) U.S. Cl. ..... 24/666; 24/591.1

(58) Field of Classification Search ..... 24/465, 24/466, 578.12, 591.1, 666, 667, 698.1; 450/63
See application file for complete search history.

(56) References Cited

U.S. PATENT DOCUMENTS

| | | | | | |
|---|---|---|---|---|---|
| 736,811 | A * | 8/1903 | Booth | 24/669 |
| 1,387,114 | A * | 8/1921 | Carr | 24/667 |
| 2,122,138 | A * | 6/1938 | Hansen | 24/667 |
| 3,869,766 | A * | 3/1975 | Raymond | 24/618 |
| 4,606,079 | A * | 8/1986 | DeWoskin | 2/338 |
| 6,199,248 | B1 * | 3/2001 | Akashi et al. | 24/693 |
| 6,253,428 | B1 * | 7/2001 | Wang | 24/701 |
| 6,321,419 | B1 * | 11/2001 | Fildan et al. | 24/114.6 |
| 6,347,438 | B1 * | 2/2002 | Fildan et al. | 24/662 |
| 6,353,978 | B1 * | 3/2002 | Kawahara et al. | 24/114.4 |
| 6,557,232 | B2 * | 5/2003 | Fildan et al. | 29/411 |
| 7,100,250 | B2 * | 9/2006 | Fildan et al. | 24/591.1 |
| 7,314,400 | B2 * | 1/2008 | Fildan et al. | 450/86 |
| 7,401,387 | B2 * | 7/2008 | Rosemann | 24/289 |
| 2006/0094336 | A1 * | 5/2006 | Fildan et al. | 450/92 |

* cited by examiner

*Primary Examiner* — Robert J Sandy
*Assistant Examiner* — Abigail E Morrell
(74) *Attorney, Agent, or Firm* — Andrew Wilford

(57) ABSTRACT

A brassiere back closure has an inelastic textile patch attached to the end of one of the brassiere wings and carries a plurality of transversely extending and longitudinally spaced rows each having at least two transversely spaced eyes on the back face. A flat body has an inner end attached to the end of the other of the wings, an opposite outer end, a front face at least partially overlapping at the outer end the back face of the patch, and a back face opposite the body front face. Respective plastic hooks generally complementary to and matable with the eyes are fixed to the body front face at the outer end so as to align with and interfit with the eyes. A transversely rigid bar on or forming part of the body prevents transverse relative movement of the hooks and bending of the body at the hooks.

9 Claims, 6 Drawing Sheets

BRASSIERE BACK CLOSURE

FIELD OF THE INVENTION

The present invention relates to a brassiere. More particularly this invention concerns a back closure or fastener for a brassiere.

BACKGROUND OF THE INVENTION

A standard brassiere comprises a pair of rearwardly open cups adapted to fit over the wearer's breasts and having inner edges that are connected together and outer edges from which extend wing straps that pass under the wearer's arms and around to the wearer's back where they overlay and are releasably joined together at a closure. A strap normally extends from the top of each cup over the respective shoulder of the wearer and is connected at the wearer's back to a top edge of the respective wing.

The standard closure is formed as a plurality of horizontally spaced vertical rows of eyes provided on an outer or back face of an end of one of the wings and a complementary vertical row of hooks on a front or inner face of the end of the other of the wings. The hooks are engaged in the eyes of one of the rows to fasten the two wing ends together. For comfort, the wings are typically made of an elastic textile, but the ends carrying the hooks and eyes are somewhat stiffer.

While the standard hook/eye closure is effective, it has several problems. The metallic hooks are themselves hard and can dig into the back of the wearer and get caught on other garments when the brassiere is laundered. The closure is also bulky so that it can be seen underneath tight clothing, creating an unattractive bump in the middle of the wearer's back. Finally, when longitudinal stress is applied pulling the two wing ends apart, the entire closure can curl, projecting out at its upper and lower edges and also at the outer edge of the back. Such curling deformation increases with tension and makes the already existing unattractive bump in the middle of the wearer's back even bigger.

Manufacture of the closure from various elements involves several assembly and fastening steps that increase the cost of the closure. They are typically stitched together and it is very difficult to provide stitching that perfectly matches the textile elements of the fastener, normally contrasting somewhat when the garment is new and always contrasting after some use.

OBJECTS OF THE INVENTION

It is therefore an object of the present invention to provide an improved brassiere back closure.

Another object is the provision of such an improved brassiere back closure that overcomes the above-given disadvantages, in particular that is extremely flat so that it can be worn under tight clothing without being visible, and that does not curl outward when the wings are tensioned.

A further object is to provide an improved and simplified method of making such a closure, one that in particular avoids the use of unattractive stitching.

SUMMARY OF THE INVENTION

A closure for connection between ends of two back wings of a brassiere has according to the invention an inelastic textile patch having a back face turned away from a wearer of the brassiere and an opposite front face. The patch is attached to the end of one of the wings and carries a plurality of transversely extending and longitudinally spaced rows each having at least two transversely spaced first closure elements made of plastic on the back face. A flat body has an inner end attached to the end of the other of the wings, an opposite outer end, a front face at least partially overlapping at the outer end the back face of the patch, and a back face opposite the body front face. Respective plastic second closure elements generally complementary to and matable with the first closure elements are fixed to the body front face at the outer end so as to align with and interfit with the first closure elements. A transversely rigid bar on or forming part of the body prevents transverse relative movement of the second closure elements and bending of the body at the second closure elements.

Such a closure can be made extremely thin measured front to back, in fact as thin as 4 mm, which is considerably thinner than the 6 mm of a standard closure. What is more, the construction is such that tension exerted on it by the wings does not cause it to curl or twist back, but in fact simply makes it flatter, so that it never presents an unattractive bump, even if worn, for instance, under a snug tee shirt. This closure can be wholly made without stitching, that is by welding, normally ultrasonically, so that there is never the problem of unattractive contrasting stitching.

The first closure elements are female and U-shaped and the second closure elements are male. They are both wholly made of plastic so as not to snag, for instance, in the laundry. What is more, such completely nonmetallic construction is quite simple and cheap, and avoids some of the skin-sensitivity and allergy problems of metallic parts.

The patch according to the invention is formed by congruous front and back textile layers and the first closure elements each include a front part sandwiched between the layers, a back part matable with a respective one of the second closure elements, and a peg or web extending through the back layer between the respective front and back parts. The pegs or webs can be formed integrally with the respective front and back parts or they can be formed integrally with one of the respective front and back parts and ultrasonically welded to the other of the respective front and back parts.

Each of the layers is generally rectangular and the closure further has ultrasonic welds extending around at least three sides of the layers and bonding same together immediately inward of outer edges thereof. These welds, according to a particularly advantageous form of the invention, only extend around the three sides and the layers are separate at a fourth side. The respective wing end is received between and fastened to the layers at the fourth side. Of course one or both of the layers can also in fact be formed as an integral part of the brassiere wing if the fastener is to be manufactured with the undergarment.

In accordance with the invention transverse bar welds are formed between the rows of first closure elements. These prevent the closure from curling and maintain an accurate spacing between the first closure elements.

The flat body according to the invention can also unitarily formed of plastic with the second closure elements and rigid bar. In this case at least one flexible textile flap is secured to the rigid bar and attached to the respective wing end, or more particularly two such textile flaps sandwich and are welded to the bar and also sandwich and are attached to the respective wing end.

The method according to the invention comprises the steps of fixing a plurality of first closure elements made of plastic to a front face of an inelastic textile patch having a back face turned away from a wearer of the brassiere and an opposite front face with the first closure elements are arrayed in a plurality of transversely extending and longitudinally spaced rows on the back face and also providing a flat body having an inner end attached to the end of the other of the wings and an opposite outer end and a front face at least partially overlapping the back face of the patch at the outer end and a back face opposite the body front face. Respective plastic second closure elements generally complementary to the first closure elements are fixed to the body front face at the outer end so as to align with and interfit with the first closure elements. A transversely rigid bar is formed on or as part of the body so as to prevent transverse relative movement of the second closure elements and bending of the body at the second closure elements.

As described above, the patch is formed by congruous front and back textile layers and the first closure elements each include a front part sandwiched between the layers, a back part matable with a respective one of the second closure elements, and a peg or web extending through the back layer between the respective front and back parts. These front and back parts can be unitarily formed with each other, with the pegs or web, and with the bar in a single shot by injection molding, or alternately the pegs or webs are formed integrally with one of the respective front and back parts and are welded to the other of the respective front and back parts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1A:
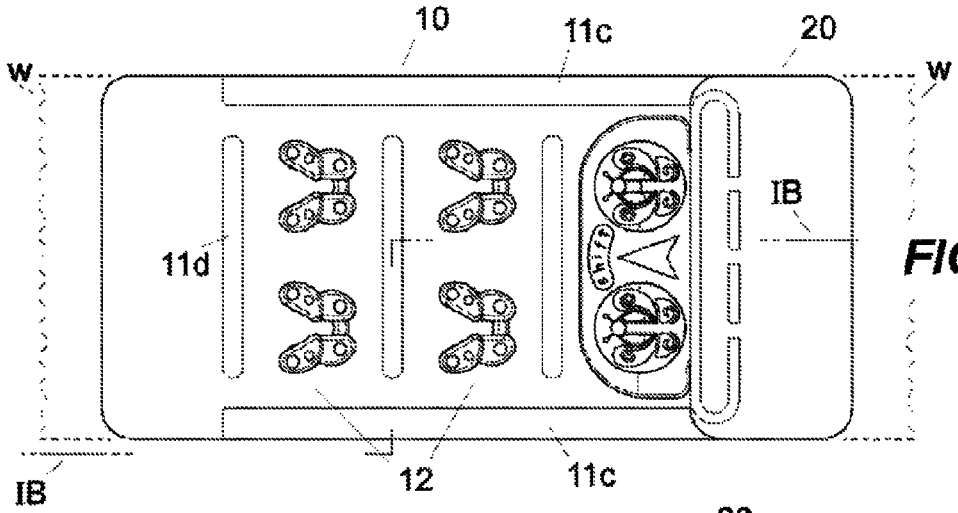
FIG. 1A is a front view of the closure according to the invention.
Figure 1B:
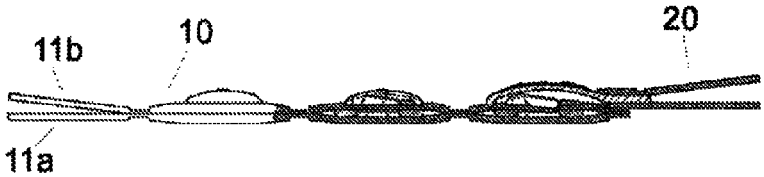
FIG. 1B is a section taken along line IB-IB of FIG. 1A.
Figure 1C:
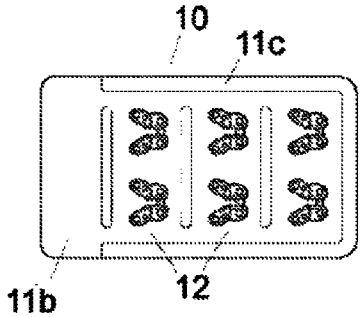
FIGS. 1C and 1D are front views of the female and male parts of the closure.
Figure 1D:
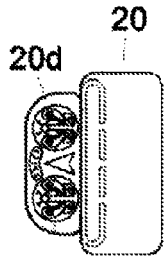
Figure 1E:
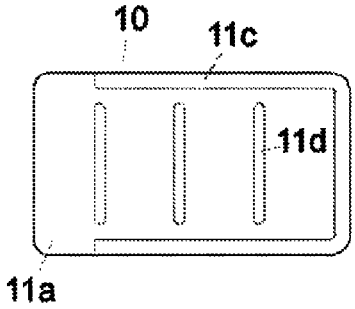
FIGS. 1E and 1F are back views of the female and male parts of the closure.
Figure 1F:
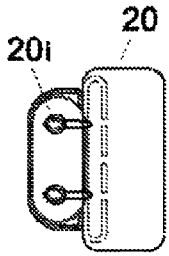

As seen in FIGS. 1A-1F a closure according to the invention basically comprises a female part 10 normally attached to one wing shown in dashed lines at W and a male part 20 attached to another wing W. FIG. 1A shows the closure as seen from the rear, that is from behind the person wearing it, when attached together in its longest setting.

The female part 10 is formed by front and back layers 11*a* and 11*b* of which at least one, here both, is made of a non-stretch textile, typically a tricot knit microfiber. These layers 11*a* and 11*b* are bonded together along their longitudinal edges and outer end at a U-shaped weld 11*c*. In addition crosswise welds 11*d* are longitudinally spaced along the ultrasonically welded-together layers 11*a* and 11*b* within the area defined by the weld 11*c* to further stabilize the assembly by eliminating stretch. The U-shaped edge weld 11*c* ends short of the inner ends of the layers 11*a* and 11*b* and the innermost crosswise weld 11*d* also is spaced outward from this inner end so that the two layers 11*a* and 11*b* are separate at the inner end of the female part 10, forming fastening lips. This allows the two layers 11*a* and 11*b* to be sandwiched to opposite inner and outer faces of the respective wing W and fastened thereto by welding or stitching in a manner providing a solid anchoring and smooth joint.

Three rows of two female butterfly elements 12 are secured to the back face of the back layer 11*b* in longitudinally spaced transversely extending rows. In principal each row could have more than two such elements 12 for brassieres with larger cup sizes, but in practice as described below it is often only necessary to increase the transverse spacing of the two elements 12, not the number, with an increase in the transverse dimension of the fastener to match wider wings W.

Figure 2A:
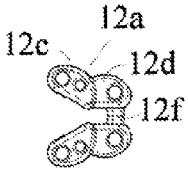
FIGS. 2A and 2B are front and back views of the outer female element.
Figure 2D:
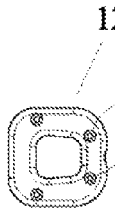
FIGS. 2D and 2E are front and back views of the inner female element.
Figure 2B:
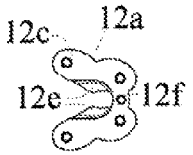
Figure 2E:
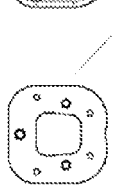
Figure 2C:
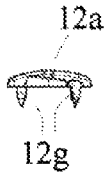
FIG. 2C is a cross section through the outer female element.
Figure 2F:
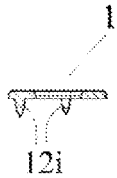
FIG. 2F is a cross section through the inner female element.
Figure 2I:
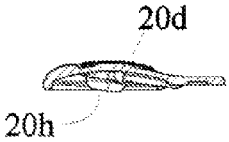
FIG. 2I is a section taken along line 2I-2I of FIG. 2G.

Each female element 12 comprises as better shown in FIGS. 2A-2C a butterfly-shaped back part 12*a* that sits on the back face of the back layer 11*b* and a rectangularly annular inner part 12*b* (FIGS. 2D-2F) that is sandwiched between the front face of the back layer 11*b* and the back face of the front layer 11*a*. The front part 12*a* is butterfly shaped with a pair of wings having diverging outer portions 12*c*, parallel inner portions 12*d* formed with overhangs 12*e*, and a bight 12*f* joining the bottom ends of the inner portions 12*d*. Prongs 12*g* extend from the front face of the female element 12 through the back layer 11*b* and seat in holes 12*h* in the inner part 12*b* that in turn has prongs 12*i* functioning similarly.

The male part 20 as better shown in FIGS. 2G-2J comprises a flexible but normally inelastic textile part formed by front and back layers 20*a* and 20*b* formed in turn by halves of a common textile rectangle (FIG. 2J) with a central slot 20*k*, and a plastic part 20*c* with an outer part 20*d* and an inner bar part 20*e* joined by a somewhat narrower web 20*f* adapted to fit through the slot 20*c* as will be described below. The outer part

20*d* has a back face provided with decoration and indicia 20*g* including the word "SHIFT" and an arrow pointing outward to indicate to the user which way to slide this part 20 to open the closure.

It would also be possible to make a system where the flaps 20*a* and 20*b* were not a single piece, and one of the pieces is made large to cover the entire back or outer face of the plastic outer part 20*d* so that nothing but textile is seen from the rear.

The front face of the outer part 20*d* is formed with a pair of hook elements 20*h* each having an enlarged head 20*i* and an inwardly extending ridge 20*j*. The heads 20*i* can fit underneath the overhangs 12*e* to lock the parts 10 and 20 together against separation in any direction but toward each other, that is by moving the part 20 in the direction of the "SHIFT" arrow of the indicia 20*g*. The ridges 20*j* that are inward of the heads 20*i* serve to guide the heads 20*i* into position by sliding between the arms 12*c* of the parts 12*a*.

The female part 10 of this closure is made as shown in FIGS. 3A-3F by first laminating together two blanks 11*a*' and 11*b*' (FIGS. 3A and 3B) that are of the same shape as the layers 11*a* and 11*b*, but larger all around by a dimension D here equal to about 0.125 in.

Figure 3A:
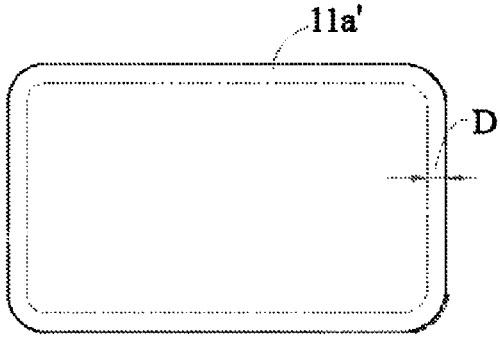
FIGS. 3A and 3B are views of the base and patch fabric blanks for the layers of the female part.
Figure 3B:
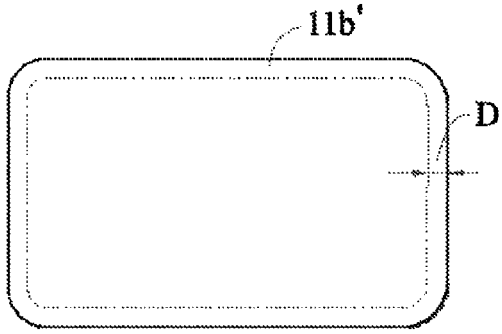
Figure 3C:
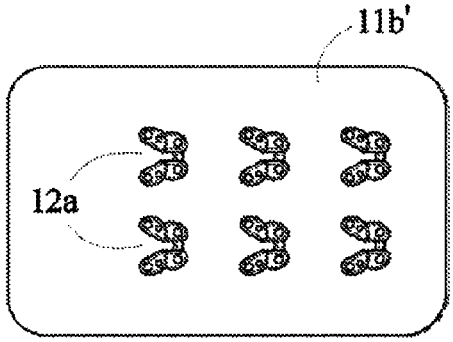
FIGS. 3C and 3D are front and back views after installation of the inner and outer female elements on the base blank.
Figure 3D:
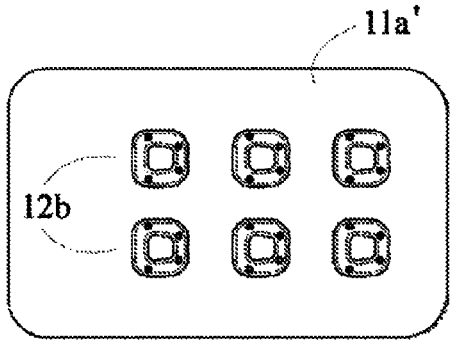

In a first step shown in FIGS. 3C and 3D the parts 12*a* and 12*b* are fitted together in the three rows of two each (to which the invention is in no way limited) with the prongs 12*g* and 12*i* poking through the blank 11*b*' and ensuring exact relative positioning of these parts 12*a* and 12*b*. The fitted together parts 12*a* and 12*b* are, in this position, welded together ultrasonically at the outer ends of the prongs where they project through to mushroom them over and lock the parts 12*a* and 12*b* solidly together with the blank 11*b*' between them.

Figure 3E:
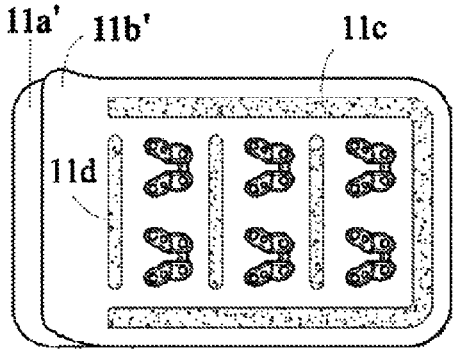
FIG. 3E is a front view of the blanks after heat-sealing them together.

Then as shown in FIG. 3E the two blanks 11*a*' and 11*b*' are fitted congruently together, and the welds 11*c* and 11*d* are formed, which can be done ultrasonically. This stiffens the assembly somewhat and completely encloses the parts 12*b*.

In a final step an edge 11*e* is trimmed off the blanks 11*a*' and 11*b*' to turn them into the layers 11*a* and 11*b*. This trimming is done cold, immediately adjacent or slightly outside the ultrasonic weld 11*c* so that, as the fabric of the layers 11*a* and 11*b* frays slightly with use and laundering a soft edge is left.

The embodiment of FIGS. 4A-6F functions similarly and has all the advantages of the first embodiment described above but differs with respect to how it is assembled, and the construction of the male part 30.

Figure 2G:
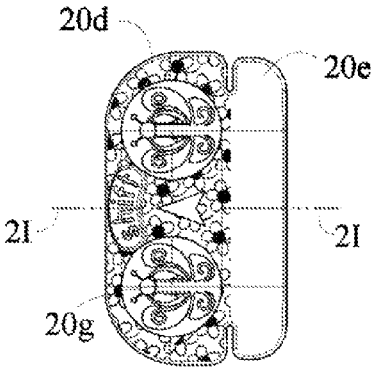
FIGS. 2G and 2H are front and back views through the plastic part of the male part of the closure.
Figure 2H:
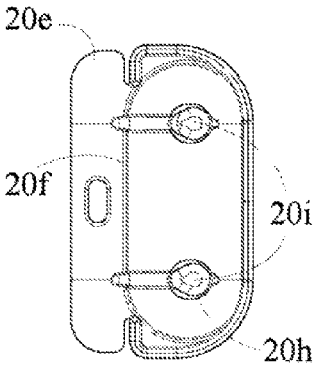
Figure 2J:
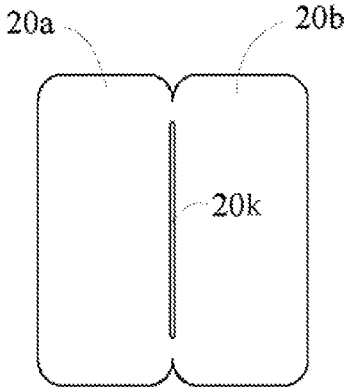
FIG. 2J is a front view of the fabric for the male part of the closure.
Figure 5A:
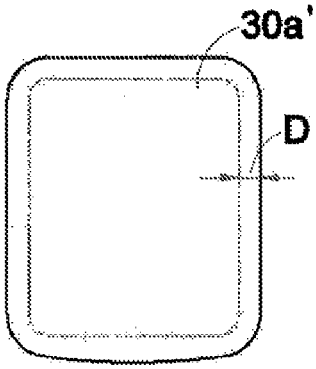
FIGS. 5A and 5B are views of the base and patch fabric blanks for the layers for the female part of the second closure.
Figure 5B:
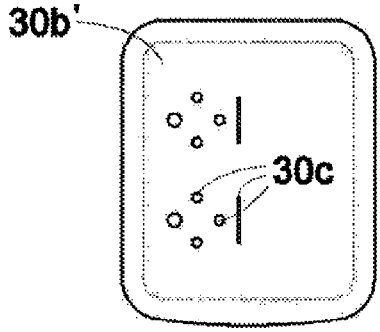

More particularly, the male part 30 here is not formed of two pieces, namely the textile element shown in FIG. 2J and the plastic part shown in FIGS. 2G and 2H. Instead it is formed as shown in FIGS. 5A and 5B starting from two blanks 30*a*' and 30*b*', the former a simple unperforated patch and the latter formed with an number of throughgoing holes 30*c*, both oversize by the dimension D.

Figure 5C:
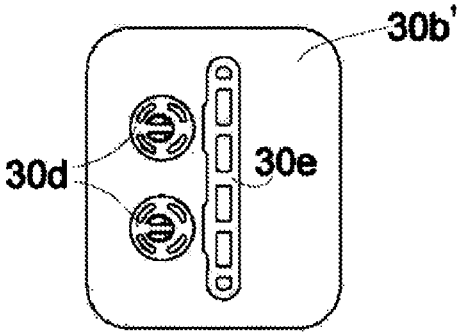
FIGS. 5C and 5D are front and back views after installation of the plastic parts on the base blank.
Figure 5D:
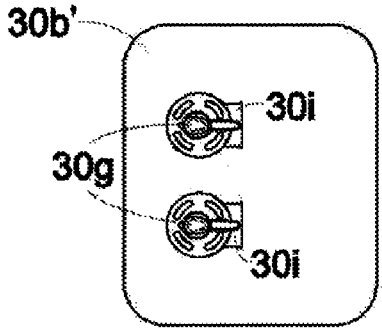

The blank 30*b*' is then as shown in FIGS. 5C and 5D fitted between two mold or die halves and a synthetic resin is injected into it to form on the front face of the blank 30*b*' two small circular back buttons 30*d* and a crosswise bar 30*e* and on its back face two flat buttons 30*f* from which project heads 30*g* identical to the heads 20*i* and ridges 30*g* identical to the ridge 20*j*. An integral flat web 30*i* is simultaneously formed that extends through the blank 30*b*' between the buttons 30*d* and 30*f*, which are also connected together through integral studs extending through the holes 30*c* between the buttons 30*d* and 30*f*. Thus all the plastic parts are formed in a single shot and are unitary with each other.

Figure 5E:
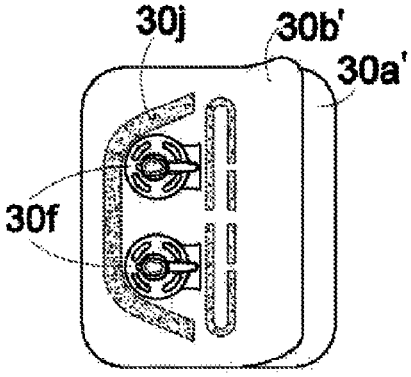
FIG. 5E is a front view of the blanks after heat-sealing them together.
Figure 5F:
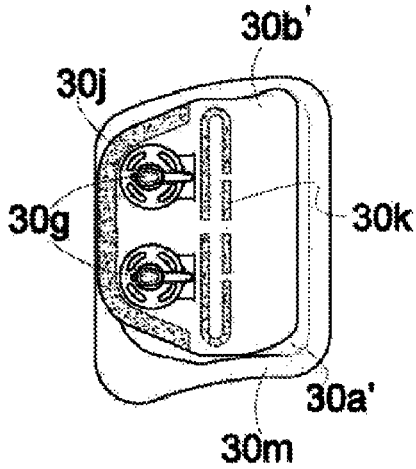
FIG. 5F is a front view showing trimming of the sealed-together blanks.

Then as shown in FIG. 5E, the two blanks 30*a*' and 30*b*' are congruently juxtaposed so that the front blank 30*a*' covers the buttons 30*d* and the reinforcing bar 30*e*, and the two blanks 30*a*' and 30*b*' are ultrasonically welded together at a U-shaped weld 30*j* extending around the buttons 30*d* and 30*f* and a straight ultrasonic weld 30*k* at the bar 30*e* to bond the two blanks solidly together and to the plastic parts 30*d*, 30*f*, 30*e*, and 30*i*.

Finally a cold cut is formed around the weld 30*j*, that is spaced slightly outward from it, to cut off an edge 30*m* to form front and back layers 30*a* and 30*b* with a soft edge and a pair of lips between which the respective wing W can be anchored.

The female part of the second embodiment is formed as shown in FIGS. 6A-6F with integrally injection molded plastic parts also.

Figure 6A:
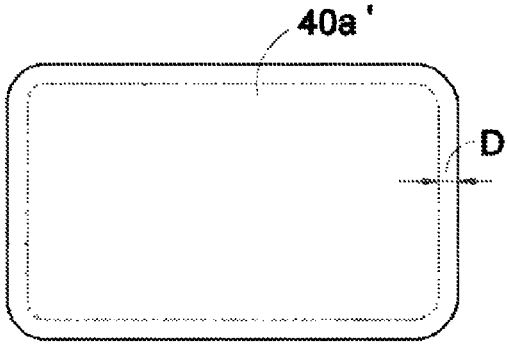
FIGS. 6A and 6B are views of the base and patch fabric blanks for the layers for the male part of the second closure.
Figure 6B:
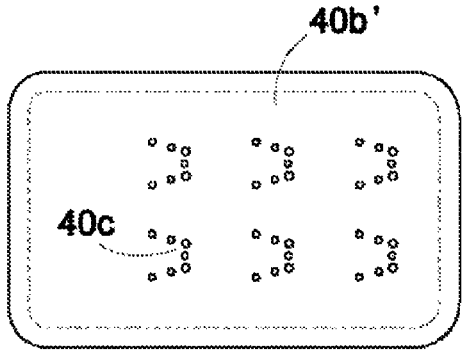

More particularly as shown in FIGS. 6A and 6B, the process starts with two blanks 40*a*' and 40*b*', the former identical to the blank 11*a*' and the latter only different from the blank 11*b*' in that it is formed with six U-shaped arrays of throughgoing holes.

Figure 6C:
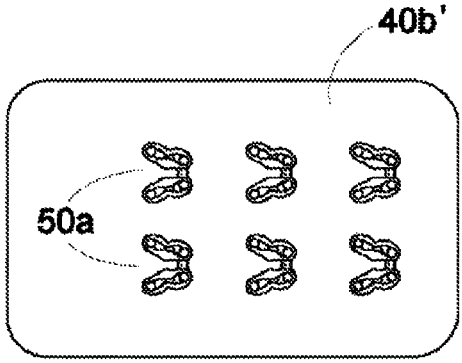
FIGS. 6C and 6D are front and back views after installation of the plastic parts on the base blank.
Figure 6D:
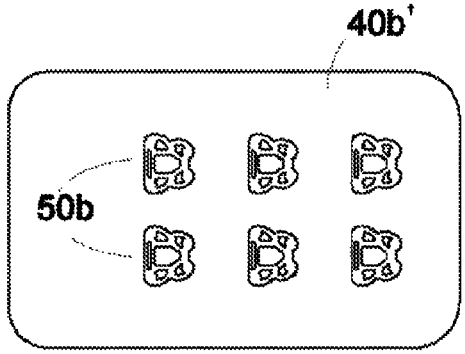
Figure 6E:
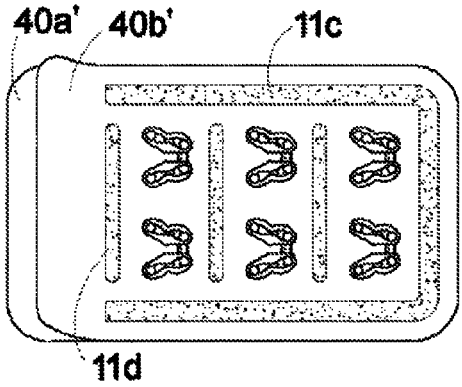
FIG. 6E is a front view of the blanks after heat-sealing them together.
Figure 6F:
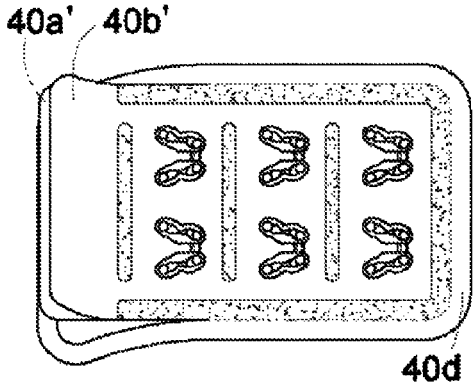
FIG. 6F is a front view showing trimming of the sealed-together blanks.

The blank 40*b*' is then, like the blank 30*b*', clamped between two die halves into which plastic is injected to form parts 50*a* and 50*b* essentially identical to the parts 12*a* and 12*b*, except that they are unitarily formed with each other and connected together by tiny integral pegs extending though the holes 40*c*. This is shown in FIGS. 6C and 6D.

Figure 3F:
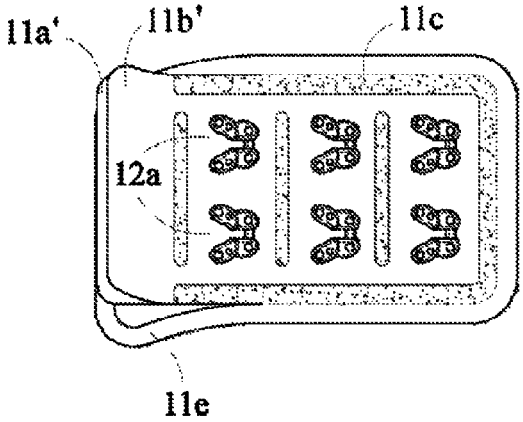
FIG. 3F is a front view showing trimming of the sealed-together blanks.
Figure 4A:
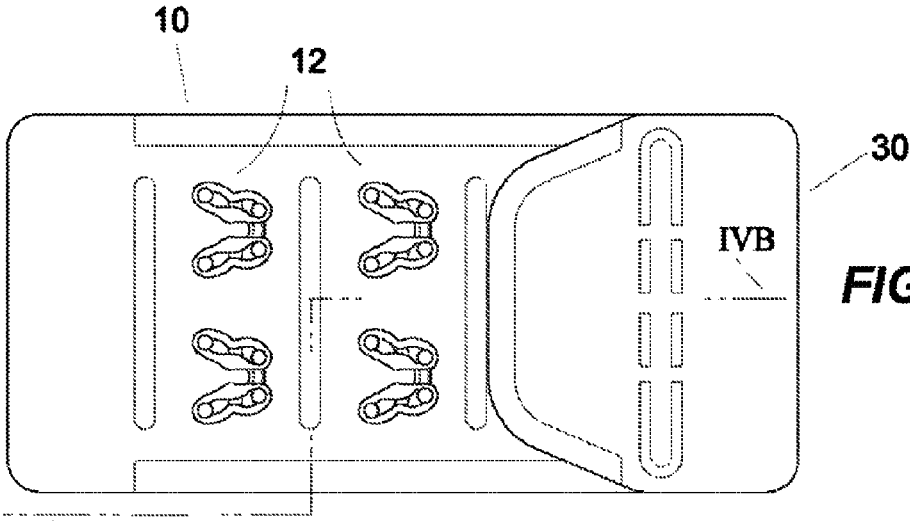
FIG. 4A is a front view of a second closure according to the invention.
Figure 4B:
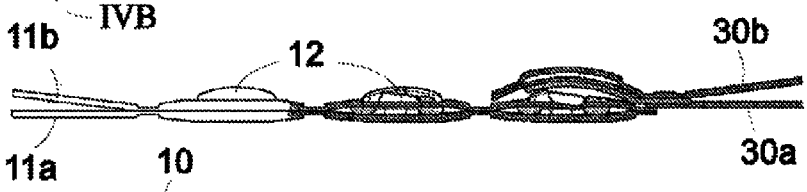
FIG. 4B is a section taken along line IVB-IVB of FIG. 4A.
Figure 4C:
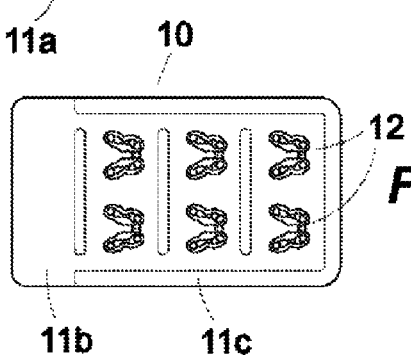
FIGS. 4C and 4D are front views of the female and male parts of the second closure.
Figure 4D:
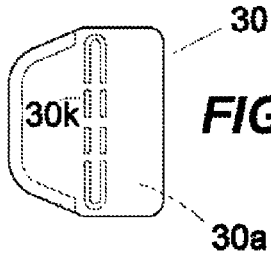
Figure 4E:
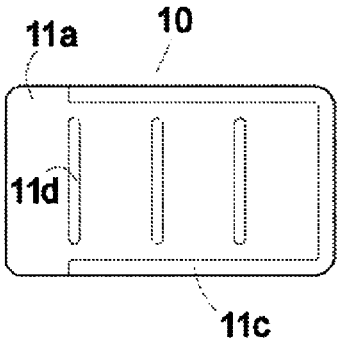
FIGS. 4E and 4F are back views of the female and male parts of the second closure.
Figure 4F:
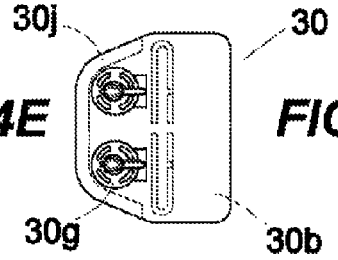

The steps shown at 6E and 6F are identical to those of FIGS. 3E and 3F, with welds 11*c* and 11*d* formed, then an edge 40*d* trimmed off to leave a front layer 40*a* and back layer 40*b* with a soft edge and two flaps that can be joined to a wing end.

We claim:

1. A closure for connection between ends of two back wings of a brassiere, the closure comprising:

an inelastic textile patch formed by congruous front and back textile layers and having a back face turned away from a wearer of the brassiere when worn and an opposite front face, the patch being attached to the end of one of the wings;

a plurality of transversely extending and longitudinally spaced rows each having at least two transversely spaced first closure elements made of plastic fixed to the back face;

a flat body having an inner end attached to the end of the other of the wings, an opposite outer end, a front face at the outer end at least partially overlapping the back face of the patch, and a back face opposite the body front face;

respective plastic second closure elements generally complementary to and matable with the first closure elements and fixed to the body front face at the outer end so as to align with and interfit with the first closure elements, the first closure elements each including a front part sandwiched between the layers, a back part matable with a respective one of the second closure elements, and a peg or web extending through the back layer between the respective front and back parts; and a transversely rigid bar on or forming part of the inner end of the body and preventing transverse relative movement of the second closure elements and bending of the body at the second closure elements.

2. The closure defined in claim 1 wherein the first closure elements are female and U-shaped and the second closure elements are male.

3. The closure defined in claim 1 wherein the peg or web is formed integrally with the respective front and back parts.

4. The closure defined in claim 1 wherein the peg or web is formed integrally with one of the respective front and back parts and are welded to the other of the respective front and back parts.

5. The closure defined in claim 1 wherein each of the layers is generally rectangular, the closure further comprising:

welds extending around at least three sides of the layers and bonding the layers together immediately inward of outer edges thereof.

6. The closure defined in claim 5 wherein the welds only extend around the three sides and the layers are separate at a fourth side, the respective wing end being received between and fastened to the layers at the fourth side.

7. The closure defined in claim 5, further comprising:

transverse bar welds between the rows of the first closure elements.

8. The closure defined in claim 1 wherein the flat body is unitarily formed of plastic with the second closure elements and the rigid bar.

9. A closure for connection between ends of two back wings of a brassiere, the closure comprising:

an inelastic textile patch having a back face turned away from a wearer of the brassiere when worn and an opposite front face, the patch being attached to the end of one of the wings;

a plurality of transversely extending and longitudinally spaced rows each having at least two transversely spaced first closure elements made of plastic and fixed to the back face;

a flat body having an inner end attached to the end of the other of the wings, an opposite outer end, a front face at the outer end at least partially overlapping the back face of the patch, and a back face opposite the body front face;

respective plastic second closure elements generally complementary to and matable with the first closure elements and fixed to the body front face at the outer end so as to align with and interfit with the first closure elements;

a transversely rigid bar on or forming part of the inner end of the body and preventing transverse relative movement of the second closure elements and bending of the body at the second closure elements, the flat body being unitarily formed of plastic with the second closure elements and the rigid bar; and two textile flaps sandwiching and ultrasonically welded to the bar and also sandwiching and attached to the respective wing end.

* * * * *